United States Patent [19]

Uyeda

[11] 4,353,231

[45] Oct. 12, 1982

[54] FRICTION DRIVE-SNAP INNER FIT TUMBLER WHEEL CONSTRUCTION

[75] Inventor: Tim M. Uyeda, South San Gabriel, Calif.

[73] Assignee: La Gard, Inc., Torrance, Calif.

[21] Appl. No.: 186,288

[22] Filed: Sep. 11, 1980

[51] Int. Cl.[3] ..... E05B 15/14; E05B 37/00

[52] U.S. Cl. ..... 70/316; 70/323

[58] Field of Search ..... 70/315, 316, 317, 327, 70/328, 323, DIG. 75

[56] References Cited

U.S. PATENT DOCUMENTS

| | | | |
|---|---|---|---|
| 145,618 | 12/1873 | Brettell | 70/316 |
| 3,237,435 | 3/1966 | Paul | 70/315 |
| 3,410,121 | 11/1968 | Morin | 70/316 |
| 4,142,388 | 3/1977 | Phillips . | |
| 4,312,199 | 1/1982 | Uyeda . | |

*Primary Examiner*—Robert L. Wolfe

*Attorney, Agent, or Firm*—Poms, Smith, Lande & Rose

[57] ABSTRACT

Simplified tumbler wheel construction including an outer gate ring and an inner drive ring wherein the two rings are mounted together in snap-lock fashion.

The drive ring includes an undulated surface on its outer rim for mating engagement with an inner undulated surface on the mounting surface of the gate ring. The two rings are constructed of suitable resilient material resulting in passive biasing of the undulated surfaces together during normal operation. Adjustment of the drive ring relative the gate ring is accomplished by blocking rotation of the gate ring while applying a rotative force to the drive ring in excess of a predetermined amount to rotate the undulated surfaces relative each other against the resilient bias provided by the two rings. The amount of bias against rotation is controlled by an appropriately placed slot outward of the undulated surface on the gate ring to lower bias resistance to expansion during tumbler wheel adjustment.

13 Claims, 7 Drawing Figures

Fig. 1
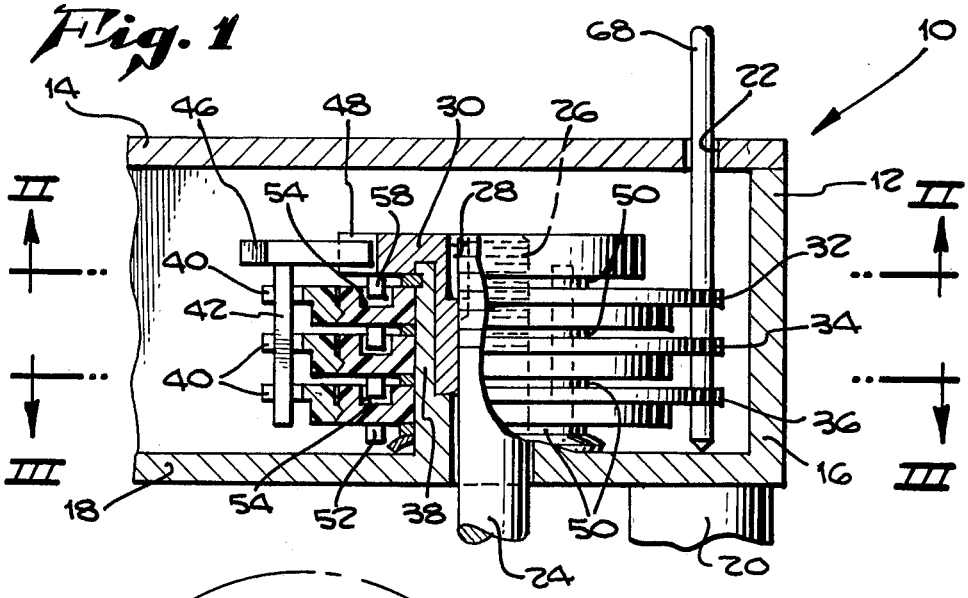
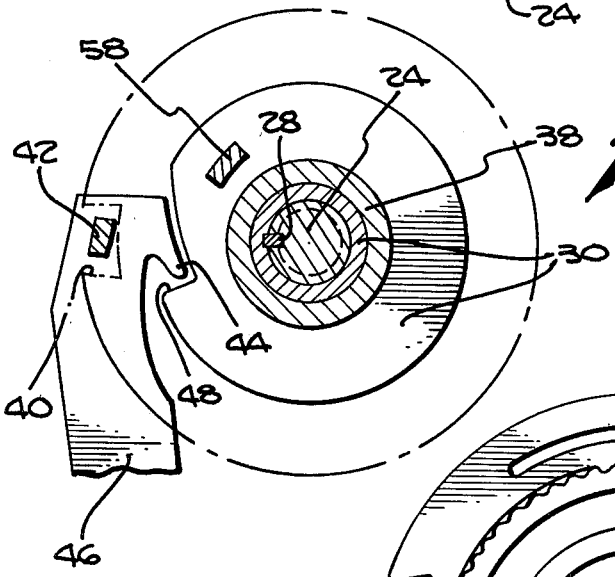
Fig. 2.
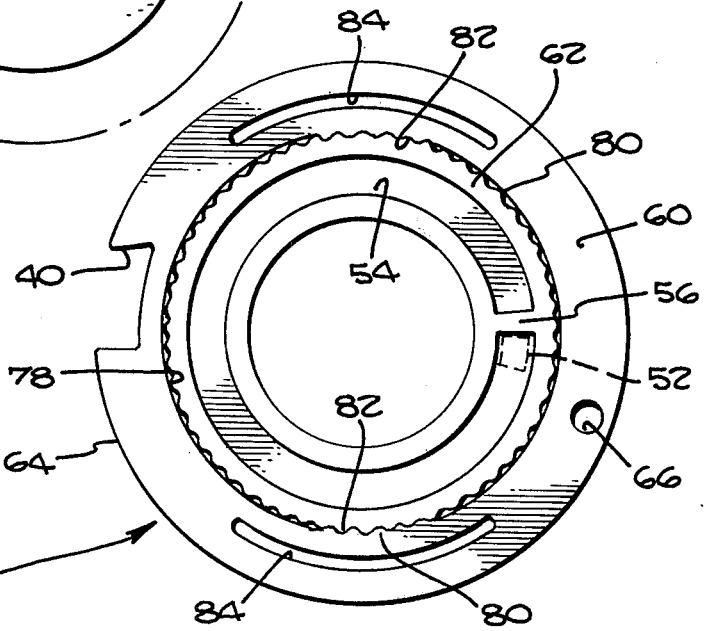
Fig. 3.

FRICTION DRIVE-SNAP INNER FIT TUMBLER WHEEL CONSTRUCTION

BACKGROUND OF THE INVENTION

The present invention relates generally to tumbler wheels for use in combination locks. More specifically, the present invention relates to adjustable tumbler wheel constructions which are used in adjustable combination locks.

Combination locks having tumbler wheels which may be adjusted to provide different combinations are experiencing widespread and increasing use. An adjustable combination lock has many apparent advantages. For example, if the combination becomes to widely known, rather than replacing the lock, the combination is simply changed. Further, the security provided by the combination lock may also be increased by frequent combination changes to prevent a would-be thief from memorizing any one combination. Another major advantage of adjustable combination locks is the convenience provided by allowing any given individual to set the combination to a desired sequence of numbers which for one reason or another may be easily memorized.

In general, adjustable combination locks utilizing tumbler wheels include a combination dial which is attached to a drive shaft. Typically, three tumbler wheels are mounted on the drive shaft with only one tumbler wheel being directly driven by the drive shaft. The other two wheels are indirectly driven by a series of tabs and/or grooves communicating between the tumbler wheels. The basic adjustable tumbler wheel includes an outer gate ring which has a gate or indention formed in the periphery thereof. A latch bolt lever or other actuation bar rides around the periphery of the gate ring. Actuation of the latch bolt lever to unlock the combination lock can only be accomplished once the gates of all gate rings are aligned. Alignment of the gate rings is accomplished by selective rotation of the drive shaft to selectively drive the gates into alignment. The gate rings are mounted concentrically about inner drive rings. In a non-adjustable combination lock, the drive ring and gate ring would generally be integral members whose position relative each other is fixed. In adjustable combination locks, provision is made for rotating the drive ring relative the gate ring to move the gate to varying positions around the drive ring to allow combination adjustment.

A typical adjustable tumbler wheel construction is disclosed in U.S. Pat. No. 4,142,388 issued to Peter J. Phillips on Mar. 30, 1977. The adjustable tumbler wheel of Phillips is typical of prior art adjustable tumbler wheels which require special tools for combination changes. Phillips requires the use of a special half moon shaped tool which is inserted into the gate ring where it is turned to move a locking member from its engaged position with the drive ring to allow rotation of the drive ring relative to the gate ring to accomplish combination changes. Another adjustable tumbler ring construction is disclosed in my co-pending U.S. Pat. application, Ser. No. 152,195 filed on May 22, 1980 and now U.S. Pat. No. 4,312,199. This particular adjustable tumbler wheel construction utilizes a lightweight plastic gate ring which is mounted on the drive ring by way of a lock ring which is typically employed for such purposes. Further, the means for providing adjustment of the drive ring relative the gate ring are provided by a cam member which also requires the use of a special tool.

It is therefore, desirable to provide a simple lightweight adjustable tumbler wheel construction where the gate ring can be mounted quickly and conveniently on the drive ring and wherein the gate ring may be adjusted about the drive ring quickly, conveniently and reliably without the use of special tools.

SUMMARY OF THE INVENTION

Accordingly, an object of the present invention is to disclose and provide an adjustable tumbler wheel construction having few parts for economical production and reliable performance.

A further object of the present invention is to disclose and provide a tumbler wheel construction made of a lightweight, easily and economically produced material such as plastic.

Another object of the present invention is to disclose and provide a tumbler wheel construction wherein adjustment of the drive ring relative to gate ring may be accomplished simply by blocking rotation of the gate ring while applying a rotative force in excess of a predetermined amount to the combination lock dial.

A final object of the present invention is to disclose and provide a method for adjusting the lock combination wherein the rotation of the gate rings is blocked and the new combination set by selective rotation of the combination dial.

The above objects and others are accomplished in accordance with the present invention by the use of a friction drive-snap lock interfit tumbler wheel construction. The improved gate ring mounting means of the present invention includes a peripheral concave surface on the driving ring which provides a concave rib receiving groove for receiving an annular convex resilient rib on the gate ring innermounting surface to allow snap-lock mounting of the gate ring to the drive ring. In this way, the use of an extra lock ring or the like is precluded.

Means for rotating the drive ring relative the gate ring during combination changes is provided according to the present invention by means for blocking axial rotation of the gate ring and friction means for preventing rotation of the drive ring relative the gate ring except upon application of rotation force in excess of a predetermined amount to the drive ring by way of the combination dial drive shaft while the gate ring is blocked.

The friction means includes an inner annular undulated mating surface on the drive ring outer rim which mates with an outer annular concentric undulated mating surface on the gate ring mounting surface. In accordance with the present invention, the gate ring is made of a resilient material and further provided with slots radially outward of the outer undulated mating surface to allow rotation of the drive ring relative the gate ring upon application of a force in excess of a predetermined amount to the drive ring when the gate ring is blocked. As a result, no special tools are needed to operate cam members to accomplish adjustment. Rather, adjustment is simply accomplished by inserting a screwdriver or other rod shaped tool through the gate rings to block rotation while applying selective rotative force to the combination dial to overcome the frictional engagement of the undulating surfaces.

These and many other features and attendant advantages of the present invention will become apparent as the invention becomes better understood by reference to the following detailed description when considered in conjunction with the accompanying drawings.

BRIEF DESCRIPTION OF THE DRAWINGS

FIG. 1 is a partial cross-section view of a preferred adjustable combination lock utilizing adjustable tumbler wheels constructed in accordance with the present invention.

FIG. 2 is a view of FIG. 1 taken in the II—Ii plane.

FIG. 3 is a view of FIG.1 taken on the III—III plane.

DETAILED DESCRIPTION OF A PREFERRED EXEMPLARY EMBODIMENT

Figure 4:
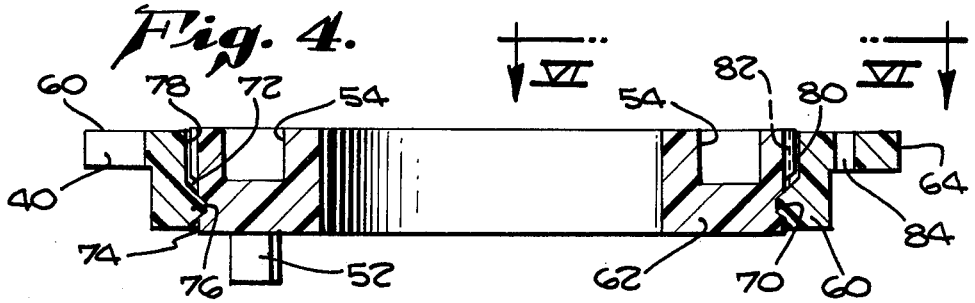
FIG. 4 is a cross-sectional view of the preferred tumbler wheel of the present invention.
Figure 5:
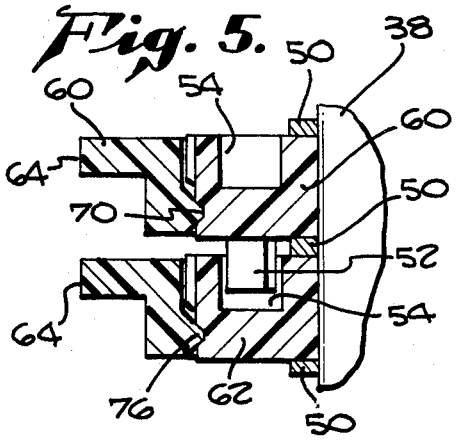
FIG. 5 is a partial cross-sectional view of two preferred tumbler wheels.

A preferred adjustable combination lock is shown generally at 10 in FIG. 1. The lock 10 includes a case 12 having rear cover 14, sidewall 16 and front wall 18. Another side wall on the left side of FIG. 1 is also provided, but it is not shown in the drawings. It is through this wall that a locking bolt or latch (not shown) typically passes for engaging the lock to a support structure. Case 12 also has top and bottom walls, which are not shown. Spacer 20 is provided for mounting the lock 10 to a safe door or other desired structure or, if desired, the lock 10 could be mounted directly to the support structure by way of front wall 18 or in the alternative the front wall 18 could comprise the front of the door or other structure. Bore 22 is provided in rear cover 14 to allow passage of a screwdriver or other suitable rod shaped tool into the case 12 for blocking rotation of the tumbler wheels. A combination dial (not shown is fixed to a drive shaft such as dial shaft 24 on the outside of the lock 10. The other end of dial shaft 24 is threaded along threads 26 and keyed at 28 to driver 30 to prevent relative rotation between the dial shaft 24 and driver 30. Rotation of driver 30 rotates the tumbler wheels, as will be described later. In the exemplary embodiment, three tumbler wheels are shown, rear tumbler 32, central tumbler 34 and forward tumbler 36. All three tumbler wheels rotate around journal member 38 in which driver 30 rotates.

Each of the tumblers 34, 36 and 38 are essentially identical with FIG. 3 showing central tumbler wheel 34. By dialing the proper combination, all of the gates such as gate 40 are aligned with fence 42 (see FIGS. 1 and 2). As shown primarily in FIG. 2, when fence 42 moves into gate 40, hook 44 on lever arm 46 engages pawl 48 on driver 30. Continued rotation of the driver 30 pulls latchbolt lever lever arm 46 to the right (FIG. 1) and through its connection with the latch bolt (not shown) unlocks the lock.

As shown in FIG. 1, the tumbler wheels 32, 34 and 36 are mounted on journal member 38 and separated by washers 50.

Figure 7:
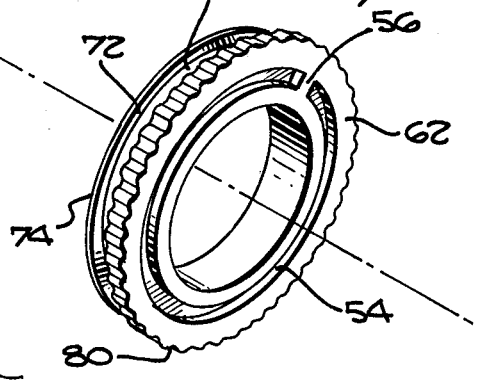
FIG. 7 is an exploded view of a preferred adjustable tumbler wheel construction in accordance with the present invention.

In order to rotate the tumbler wheels, each is provided with a projection 52 and a groove 54. As best shown in FIG. 7, each groove 54 is provided with a stop bar 56. Further, the driver 30 includes a tab 58. In operation, as dial shaft 24 is rotated, for example to the right, driver tab 58, which is disposed in groove 54 of rear tumbler wheel 32 contacts bar 56 and begins rotating the rear tumbler wheel 32. As rear tumbler wheel 32 rotates, the projection 52 on rear tumbler 32 rotates within the groove 54 on the central tumbler wheel 34 until it contacts bar 56 of central tumbler 34. At this point, both rear tumbler 32 and central tumbler 34 are being driven to the right. Likewise, upon continued rotation the forward tumbler 36 is also driven to the right as the projection 52 on central tumbler 34 contacts the bar 56 within groove 54 on the forward tumbler 36. By selective rotation of the dial shaft 24 back and forth, the gates are then moved into the appropriate aligned positions with fence 42 whereby the latchbolt lever arm 46 is received into the gate 40.

It is apparent that in order to change the combination of a lock, the relative position of the gate 40 in relation to the dial shaft 24 must be changed. To allow for this a two piece adjustable tumbler wheel is typically utilized. The following is a detailed description of the adjustable tumbler wheel construction of the present invention which provides for the position adjustment of the gates 40 relative the dial shaft 24 and associated combination dial.

To provide this adjustability, a preferred adjustable tumbler wheel in accordance with the present invention is shown in an exploded view in FIG. 7. The preferred tumbler wheel includes an outer gate ring 60 and an inner drive ring 62. The outer gate ring has a periphery 64 in which is formed a gate 40 for receiving the latchbolt lever or lever arm 46 by way of fence 42. As particularly contemplated by the present invention, means for blocking axial rotation of the gate ring is provided by blocking hole 66 which receives a screwdriver or other similarly shaped rod 68 which has been inserted through bore 22.

Preferrably, both the gate ring 60 and drive ring 62 should be made from a comparatively hard, rigid, strong, tough and resilient material. This material should also be relatively resistant to moisture and heat and additionally resistant to chemicals and solvents. The preferred material is Delrin 500 Black or equivalent. Delrin is a well-known trademark of E.I. DuPont for acetal resins. These polyacetal polymers or synthetic resins are particularly well suited for use in the present invention since they provide a tough enough material to withstand continued rotation and engagement with the fence while retaining sufficient resilience to allow snap-lock mounting of the drive ring 60 on the inner ring 62. Further, the polyacetals are characterized by high gloss-low friction surfaces which allow smooth frictional movement of the drive ring 62 relative the gate ring 60 during combination adjustments. Other plastics or resilient materials with similar properties may also be used.

Means for mounting the gate ring 60 in concentric relation with the drive ring 62, wherein the gate ring 60 is axially rotatable relative the drive ring 62 is provided by a peripheral concave surface 70 which provides a concave rib receiving groove 72 about the drive ring outer rim 74. Means for mounting the gate ring on the drive ring further include an annular convex resilient rib 76 on the gate ring inner mounting surface 78. Mounting of the gate ring 60 onto the drive ring 62 is accomplished by snap-locking the convex rib 76 within the mating concave receiving groove 72. It is essential that at least one of the rings be made from a resilient material to allow for the snap-lock mounting to be conveniently carried out. As previously discussed, it is preferred that both the gate ring 60 and drive ring 62 be made from the relatively hard and yet resilient (not brittle) acetal resins. Snap-lock mounting of the gate ring 60 on the drive ring 62 precludes the need for an extra lock ring or the like as found in prior art tumbler wheel constructions. With the convex rib 76 snap-lock seated within concave groove 72, the two rings are securely mounted to each other while still being axially rotatable relative each other.

Figure 6:
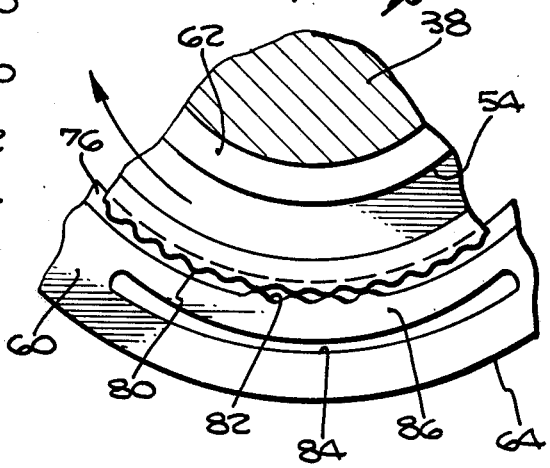
FIG. 6 is a side view of a preferred adjustable tumbler wheel of the present invention showing the drive ring being rotated relative the gate ring.
Figure 6:
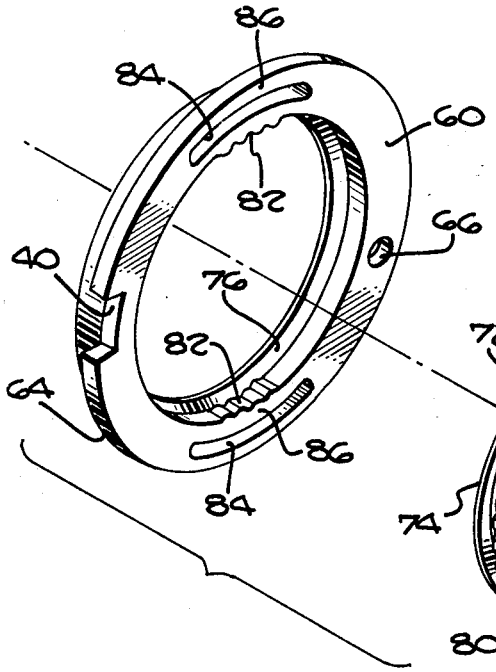

The following is a description of the friction means in accordance with the present invention for preventing rotation of the drive ring 62 relative the gate ring 60 except upon application of rotation force in excess of a predetermined amount to the drive ring 62 when the gate ring 60 is blocked or prevented from axial rotation relative the lock 10. An inner annular undulated mating surface 80 is provided on the drive ring rim 74. The undulated surface is similar to the gear teeth utilized in prior art devices except that the teeth are well-rounded to allow frictional or slidable movement without positive locking action. The friction means further includes an outer annular undulated mating surface 82 provided on the inner mounting surface 78 of gate ring 60. When the gate ring 60 is mounted on the drive ring 62, the outer undulated surface 82 mates with the inner undulated surface 80 to prevent rotation of the gate ring 60 relative the inner drive ring 62. To adjust the position of the drive ring 62 relative the gate ring 60, rotation of the gate ring 62 is blocked by inserting the rod 68 within blocking hole 66. Sufficient rotative force must be applied to drive ring 62 to cause frictional siding of the undulated surfaces over each other. This ratcheting or sliding movement is best shown in FIG. 6 where the drive ring 62 is being rotated relative the stationary gate ring 60 as shown in FIG. 6, the outer undulated surface 82 on gate ring 60 must have sufficient resiliency to allow slight movement outward to allow the peaks in the two undulating surfaces to pass over each other. To further facilitate the resilient expansion of the outer undulated surface 82, slots 84 are provided in gate ring 60 to allow outward resilient expansion of the undulated surface 82.

In usual operation, the outer undulated surface 82 is passively biased by biasing means to mating relationship with the inner undulated surface 80. Any non-common rotation of the two rings resulting in slippage, as shown in FIG. 6 is prevented by the passive biasing resulting from the resiliency of the outer gate ring 60. As a result, common rotation of the gate ring 60 and drive ring 62 is maintained at all times except when the gate ring 60 is blocked, as previously described, and a sufficient rotative force applied to the drive ring to overcome the resilient biasing of arm member 86 against the inner undulated surface 80. Preferably, the arm member 86, having the outer undulated surface 82 thereon, is integrally attached to the gate ring 60 as shown in the preferred embodiment; however, other types of resilient arm members could be used as long as they prevent rotation of the two rings relative each other except upon application of a predetermined force to the inner drive ring.

The amount of force which must be applied to the inner drive ring 62 to overcome the frictional effects between the undulated surfaces can of course be varied widely according to materials used, exact ring and undulated surface configurations and other variables. Preferably, the amount of force necessary to rotate the drive ring relative to the gate ring when the gate ring is blocked should be sufficient to prevent relative rotation during all normal operations while being low enough to allow rotation of the lock dial to change combinations without a large exertion of force.

When it is desired to change the combination of the lock as set forth above and in the drawings, the rod 68 is simply inserted through all three blocking holes of the tumbler wheels. The dial is then selectively turned to various different desired positions to set the gates relative the dial for each given tumbler. Once having set the new combination by rotation of the dial only, the rod 68 is removed with the new combination being set within the lock.

As will be realized by those skilled in the art, the present invention completely does away with the complicated cam and cam arm configurations which require special tools to operate. Further, the present invention discloses a simplified two-piece tumbler wheel which does not require the usual third lock ring component. Finally, changing of the combination can be accomplished from the front of the lock by simple rotation of the lock dial once the rotation of the gate rings have been appropriately locked.

Having thus described an exemplary embodiment of the present invention, it should be noted by those skilled in the art that the within disclosures are exemplary only and that various other alternatives, adaptations and modifications may be made within the scope of the present invention. Accordingly, the present invention is not limited to the specific embodiment as illustrated herein.

What is claimed is:

1. A tumbler wheel adapted for use in combination lock to control a latch bolt lever comprising:

an outer gate ring having a periphery with a gate formed therein for receiving said latch bolt lever;

an inner drive ring;

means for mounting said gate ring in concentric relation with said drive ring, wherein said gate ring is axially rotatable relative said drive ring;

means for blocking axial rotation of said gate ring; and friction means for preventing rotation of said drive ring relative said gate ring except upon application of rotation force in excess of a predetermined amount to said drive ring when said gate ring is blocked, said friction means including an inner annular undulated mating surface rotatably fixed relative said drive ring and an outer annular concentric undulated mating surface fixed rotatably relative said gate ring for mating engagement with said inner undulated mating surface, said friction means further including means for biasing said undulated mating surfaces to mating relationship to prevent relative rotation therebetween except upon application of said rotation force in excess of a predetermined amount to said drive ring when said gate ring is blocked.

2. A tumbler wheel apparatus according to claim 1 wherein said drive ring has an outer rim and said gate ring has an inner mounting surface, and further, said inner undulated surface is on said drive ring rim and said outer undulated surface is on said gate ring inner mounting surface.

3. A tumbler wheel apparatus according to claim 2 wherein said gate ring is formed from a resilient material.

4. A tumbler wheel apparatus according to claim 3 wherein said resilient material is an acetal resin.

5. A tumbler wheel apparatus according to claim 3 wherein said resilient material is a plastic.

6. A tumbler wheel apparatus according to claim 3 wherein said biasing means includes a resilient arm member integral with said gate ring and having said gate ring undulated surface on a radially inward surface thereof for mating with said drive ring undulated surface.

7. A tumbler wheel apparatus according to claim 6 wherein said arm member is connected itegrally on both ends to said gate ring with a slot surface radially outward of said arm member defining a slot opening for allowing radially outward resilient movement of said arm member relative said drive ring undulated surface.

8. A tumbler wheel apparatus according to claim 1 wherein said mounting means includes an annular mounting surface integral with said drive ring rim surface which matingly mounts a resilient annular mounting surface integral with said gate ring inner mounting surface in snap-lock fashion.

9. A tumbler wheel apparatus according to claim 8 wherein said drive ring mounting surface defines a peripheral concave surface providing a concave rib receiving groove about said drive ring outer rim and said gate ring mounting surface defines an annular convex rib for mating engagement with said receiving groove, said rib being sufficiently resilient to allow radial extension thereof for snap-lock engagement with said receiving groove.

10. In a combination lock having a latch bolt lever to be controlled by a plurality of tumbler wheels, said tumbler wheels each having an outer gate ring with a gate in the peripheral surface thereof for receiving said latch bolt lever, said gate ring being mounted concentrically on a drive ring, said drive ring having an inner bore for receiving a combination dial driven shaft, which selectively drives said drive rings and gate rings mounted thereon to a latch bolt lever actuation position where all of said gates are aligned and in a position to receive said latch bolt lever, wherein changing of the lock combination is accomplished by changing the rotative position of the gate with respect to said drive ring by rotating said drive ring relative said gate ring, the improvement comprising:

a peripheral concave surface on said drive ring providing a concave rib receiving groove about the drive ring outer rim;

an annular convex resilient rib on the gate ring inner mounting surface for snap-lock mounting within said receiving groove;

friction means for preventing rotation of said drive ring relative said gate ring except upon application of rotation force in excess of a predetermined amount to said drive ring when said gate ring is blocked against axial rotation; and means for blocking axial rotation of said gate ring whereby, on selective rotation of said combination dial shaft with rotation force in excess of said predetermined amount, the positions of said gates relative said drive rings are changed to change the combination of said combination lock.

11. An improved combination lock according to claim 10 wherein said friction means includes an inner annular undulated mating surface rotatably fixed relative said drive ring and an outer annular concentric undulated mating surface fixed rotatably relative said gate ring for mating engagement with said inner undulated mating surface, said friction means further including means for biasing said undulated mating surfaces to mating relationship to prevent relative rotation therebetween except upon application of rotation force in excess of a predetermined amount to said drive ring when said gate ring is blocked.

12. An improved combination lock according to claim 11 wherein said gate ring is resilient plastic and said biasing means includes a resilient arm member integral with said gate ring and having said gate ring undulated surface on a radially inward surface thereof for mating with said drive ring undulated surface.

13. An improved combination lock according to claim 12 wherein said arm member is connected integrally on both ends to said gate ring with a slot surface radially outward of said arm member defining a slot opening for allowing radially outward resilient movement of said arm member relative said drive ring undulated surface.

* * * * *